US007510160B1

(12) United States Patent
Wang

(10) Patent No.: US 7,510,160 B1
(45) Date of Patent: Mar. 31, 2009

(54) HANGER ASSEMBLY FOR CEILING FAN

(75) Inventor: Cliff Wang, Taichung (TW)

(73) Assignee: Air Cool Industrial Co., Ltd., Taichung (TW)

( * ) Notice: Subject to any disclaimer, the term of this patent is extended or adjusted under 35 U.S.C. 154(b) by 200 days.

(21) Appl. No.: 11/242,319

(22) Filed: Oct. 3, 2005

(51) Int. Cl.
*B42F 13/00* (2006.01)

(52) U.S. Cl. ..... 248/343; 248/342; 248/324; 248/317; 248/309.1; 248/288.31; 403/90; 403/93; 416/246; 416/244 R

(58) Field of Classification Search ..... 248/228.3, 248/317, 343, 342, 242, 324, 309.1, 288.31; 416/246, 244 R, 5; 403/76, 90, 93
See application file for complete search history.

(56) References Cited

U.S. PATENT DOCUMENTS 4,697,777 A * 10/1987 Yang ..... 248/343
5,090,654 A * 2/1992 Ridings et al. ..... 248/343
5,613,832 A * 3/1997 Su ..... 416/244 R
5,725,190 A * 3/1998 Cuthbertson et al. ..... 248/343
5,947,436 A * 9/1999 Bucher et al. ..... 248/345
5,984,640 A * 11/1999 Wang ..... 416/244 R
6,439,527 B1 * 8/2002 Lin ..... 248/343
6,881,037 B2 * 4/2005 Marshall ..... 416/210 R
6,981,678 B2 * 1/2006 Fu-Liang ..... 248/343
7,028,963 B1 * 4/2006 Silva et al. ..... 248/342
7,080,813 B1 * 7/2006 Frampton et al. ..... 248/343

* cited by examiner

*Primary Examiner*—J. Allen Shriver
*Assistant Examiner*—Todd M. Epps
(74) *Attorney, Agent, or Firm*—Parsons & Goltry; Michael W. Goltry; Robert A. Parsons

(57) ABSTRACT

A hanger assembly includes a hanger bracket and an adapter formed with a head and a down rod connector. The head has a lower face seated in a socket formed in the hanger bracket and an opposing upper face, and a first axis perpendicular to the upper face. The down rod connector depends downwardly from the lower face thereof to a free end adapted to be secured to a down rod, and includes a front face facing a front end of the socket, an opposing rear face facing a rear end of the socket, and a second axis extending longitudinally thereof. There is a salient angle of less than 180 degrees between the first axis and the second axis facing the front end of the socket, and the front end of the socket is received in a notch formed in the front face of the down rod connector.

15 Claims, 10 Drawing Sheets

FIGURE 3
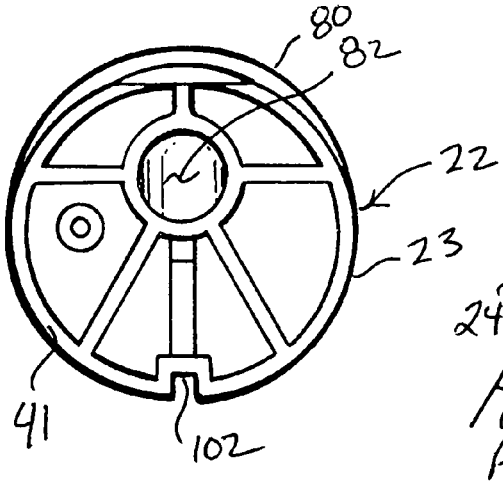
FIGURE 4
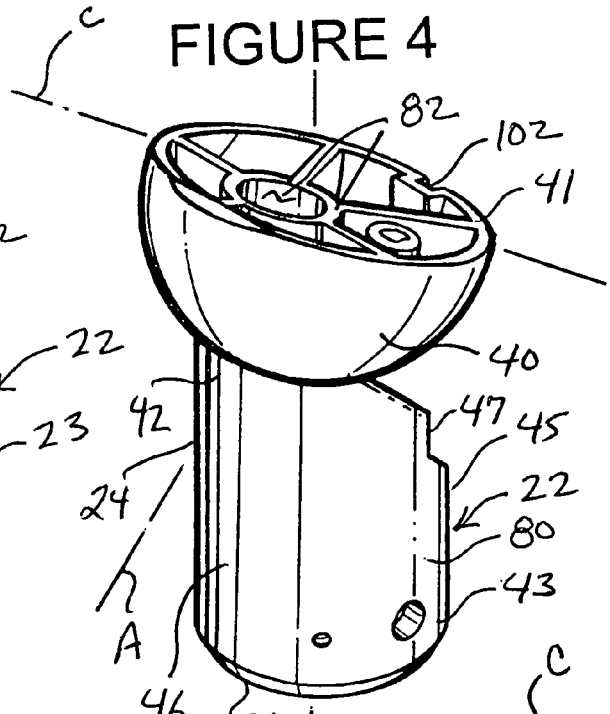
FIGURE 5
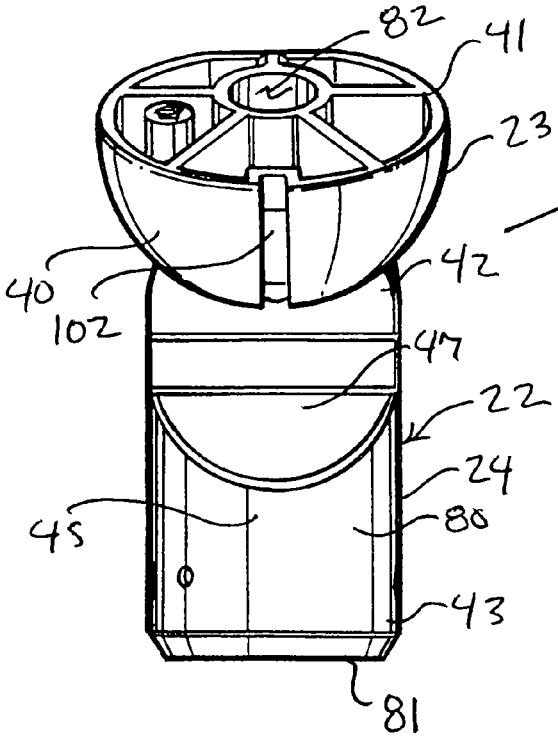
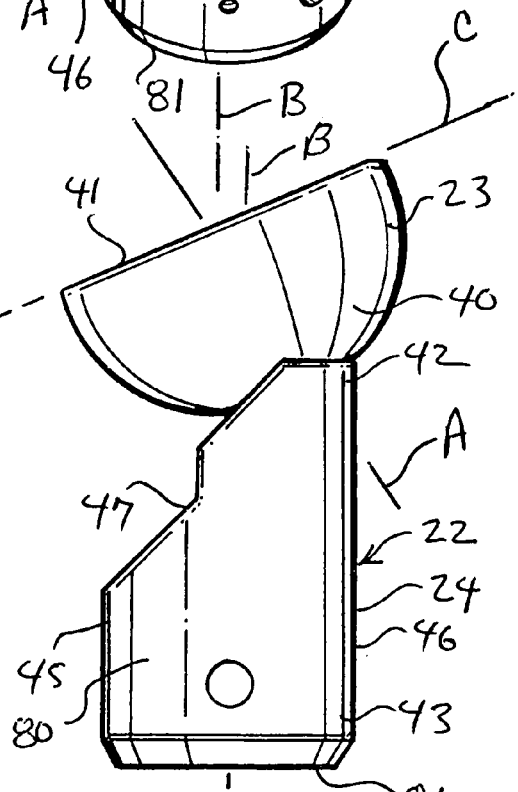
FIGURE 6

FIGURE 7
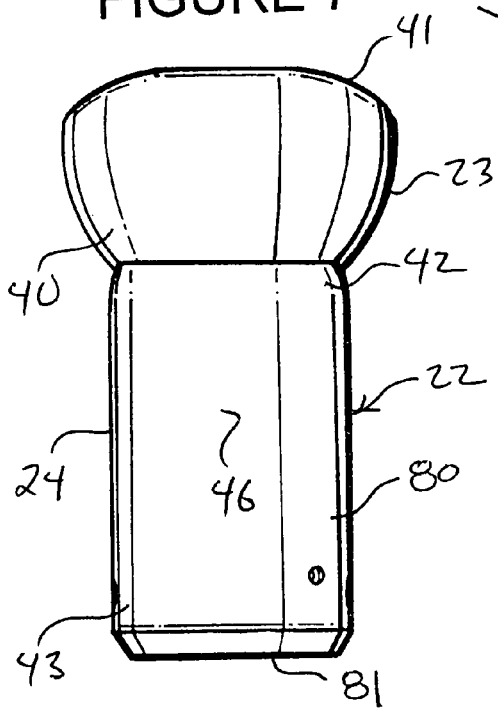
FIGURE 8
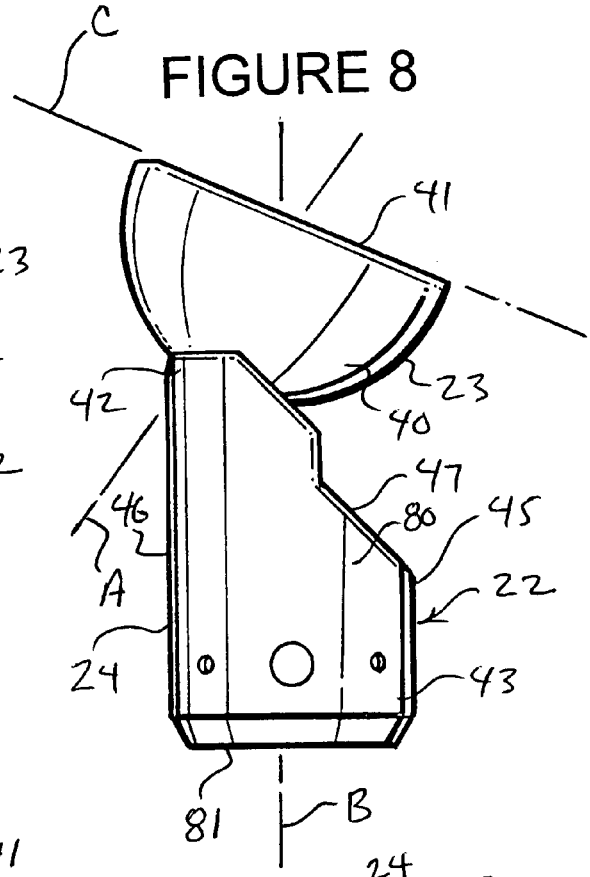
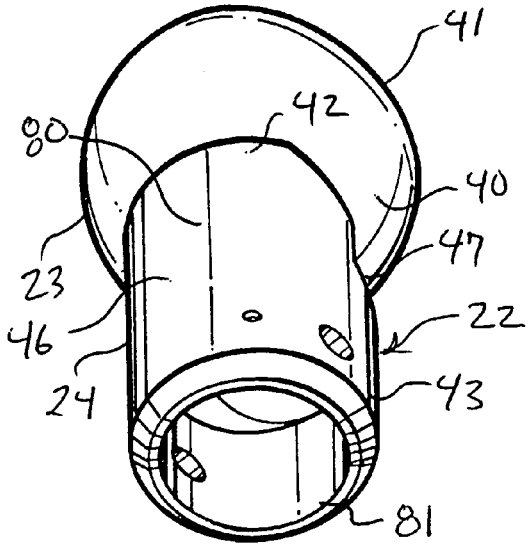
FIGURE 9
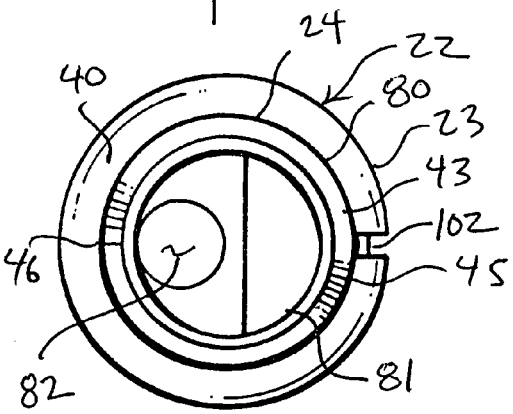
FIGURE 10

HANGER ASSEMBLY FOR CEILING FAN

FIELD OF THE INVENTION

The present invention relates to hanger assemblies for suspending ceiling fans.

BACKGROUND OF THE INVENTION

Ceiling fans are conventionally suspended from a ceiling with a hanger assembly. A known hanger assembly includes a hanger bracket securable to an overhead support member such as an electrical junction box. The hanger bracket includes slots, which receive screws for engagement to the junction box. A ball socket is formed in the hanger bracket. A ball or head is supported in the ball socket for swivel motion. An upper end of a down rod is removably attached to the ball, such as with a pin assembly or a threaded engagement assembly, and depends downwardly therefrom to a lower end adapted to be secured to a ceiling fan. A canopy, generally in the shape of an inverted dome, includes a central opening through which the down rod passes and an upper rim, which encircles the peripheral sidewall of the hanger bracket.

Conventional ceiling fan hanger assemblies, while generally acceptable for depending ceiling fans from horizontal overhead surfaces, are not entirely acceptable for depending ceiling fans from sloped overhead surfaces. This is due, at least in part, to the geometry of the socket and its interrelationship to the ball and the down rod attached thereto and the inevitable physical interaction between the down rod and the socket, which limits the angle of the down rod relative to the socket. In some instances the angle of the down rod relative to the socket is so steep that it causes the down rod to contact the rim of the hanger bracket that forms the socket, which can result in an annoying rubbing sound and often a coincident squeaking sound as a fan suspended from the down rod rotates and oscillates from side to side. Even slight oscillating fan movements can cause an irritating rubbing/squeaking sound between the down rod and the socket.

Furthermore, in order to suspend a ceiling fan from a sloped overhead surface the junction box to which the hanger bracket is attached to must be precisely aligned so that the hanger bracket is precisely aligned when it is secured to the junction box. It has been noticed that although careful consideration is often given to ensure that the junction box is properly positioned for accepting a hanger bracket from which to suspend a ceiling fan from a sloped overhead surface, adjustments to the junction box must be made in most cases, which is difficult, time consuming, and frustrating. Although skilled artisans have devoted limited efforts toward adapters for use with hanger brackets that are specifically designed to depend a ceiling fan from a sloped overhead surface, these adapters are difficult to construct, expensive, and difficult to install.

It would be highly advantageous, therefore, to remedy the foregoing and other deficiencies inherent in the prior art.

SUMMARY OF THE INVENTION

It is an object of the invention to provide a hanger assembly including a hanger bracket and an adapter formed with a head and a down rod connector which is low in cost, which is simple in structure, which is safe, in which the down rod connector is oblique relative to the head and has a notch for receiving a down angled end of the socket making the hanger assembly particularly suited to depend a load, such as a ceiling fan, from a sloped attachment face mounted at an overhead location.

According to the invention, there is provided a hanger assembly for depending a fan from a sloped attachment face including a hanger bracket including an attachment end and an opposing socket having opposing front and rear ends, the attachment end adapted to be secured to the sloped attachment face disposing the socket in a sloped orientation substantially parallel relative to the sloped attachment face with the front end thereof being down-angled relative to the rear end thereof. An adapter is formed with a head and a down rod connector. The head has a lower face seated in the socket and an opposing upper face, and a first axis perpendicular to the upper face. The down rod connector has an upper end attached to the head and depends downwardly from the lower face thereof to a lower end adapted to be secured to a down rod, a front face facing the front end of the socket, an opposing rear face facing the rear end of the socket, and a second axis extending longitudinally thereof from the upper end to the lower end. There is a salient angle of less than 180 degrees between the first axis and the second axis facing the front end of the socket, and a notch formed in the front face of the down rod connector receives therein the front end of the socket. A component-receiving space is formed between the upper face of the head and the attachment end of the hanger bracket. The attachment end of the hanger bracket is formed with opposed, substantially coextensive inwardly-directed arcuate slots each for accommodating a fastener for securing the attachment end to the sloped attachment face, and for permitting rotation of the hanger bracket relative to the sloped attachment face prior to tightening the fasteners securing the attachment end to the sloped attachment face. The front end of the socket is closed, and the rear end of the socket is open. The head and the down rod connector are preferably integrally formed. In a preferred embodiment the lower face of the head is rounded, and the upper face of the head is substantially flat defining a plane that is perpendicular relative to the first axis.

According to the invention, there is provided a hanger assembly for a ceiling fan including a junction box, mounted at an overhead location and having a sloped attachment face. A hanger bracket includes an attachment end affixed to the sloped attachment face and an opposing socket spaced from and substantially parallel to the sloped attachment face of the junction box and having opposing front and rear ends, in which the front end of the socket is down-angled relative to the rear end of the socket. An adapter is formed with a head and a down rod connector. The head has a lower face seated in the socket and an opposing upper face, and a first axis perpendicular to the upper face. The down rod connector has an upper end attached to the head and depends downwardly from the lower face thereof to a lower end adapted to be secured to a down rod, a front face facing the front end of the socket, an opposing rear face facing the rear end of the socket, and a second axis extending longitudinally thereof from the upper end to the lower end. There is a salient angle of less than 180 degrees between the first axis and the second axis facing the front end of the socket, and the front end of the socket is received in a notch formed in the front face of the down rod connector. A component-receiving space is formed between the upper face of the head and the attachment end of the hanger bracket. The attachment end of the hanger bracket is formed with opposed, substantially coextensive inwardly-directed arcuate slots each accommodating therethrough a fastener securing the attachment end to the attachment face of the junction box, and for permitting rotation of the hanger bracket relative to the sloped attachment face prior to tightening the fasteners securing the attachment end to the sloped attachment face. The front end of the socket is closed, and the rear end of the socket is open. The head and the down rod connector are preferably integrally formed. In a preferred embodiment the lower face of the head is rounded, and the upper face of the head is substantially flat defining a plane that is perpendicular relative to the first axis.

In a sloped attachment face disposed at an elevated location, and a hanger bracket including an attachment end affixed to the sloped attachment face and an opposing socket spaced from and substantially parallel to the sloped attachment face and having opposing front and rear ends, the front end down-angled relative to the rear end, improvements therein according to the principle of the invention include an adapter formed with a head and a down rod connector, in which the head has a lower face seated in the socket and an opposing upper face, and a first axis perpendicular to the upper face, and in which the down rod connector has an upper end attached to the head and depends downwardly from the lower face thereof to a lower end adapted to be secured to a down rod, a front face facing the front end of the socket, an opposing rear face facing the rear end of the socket, and a second axis extending longitudinally thereof from the upper end to the lower end. According to the improvements of this embodiment of the invention, there is a salient angle of less than 180 degrees between the first axis and the second axis facing the front end of the socket, and a notch formed in the front face of the down rod connector receives therein the front end of the socket. The head and the down rod connector are preferably integrally formed. In a preferred embodiment the lower face of the head is rounded, and the upper face of the head is substantially flat defining a plane that is perpendicular relative to the first axis.

Consistent with the foregoing summary of preferred embodiments and the ensuing specification, all of which are to be taken together, the invention also contemplates associated embodiments.

BRIEF DESCRIPTION OF THE DRAWINGS

Referring to the drawings:

FIG. 3 is a top plan view of the adapter of FIG. 1;

FIG. 4 is a top perspective view of the adapter of FIG. 1;

FIG. 5 is a front elevational view of the adapter of FIG. 1;

FIG. 6 is a right side elevational view of the adapter of FIG. 1;

FIG. 7 is a rear elevational view of the adapter of FIG. 1;

FIG. 8 is a left side elevational view of the adapter of FIG. 1;

FIG. 9 is a bottom perspective view of the adapter of FIG. 1;

FIG. 10 is a bottom plan view of the adapter of FIG. 1;

DETAILED DESCRIPTION OF A PREFERRED EMBODIMENT

§A. Overview of the Hanger Assembly

Figure 1:
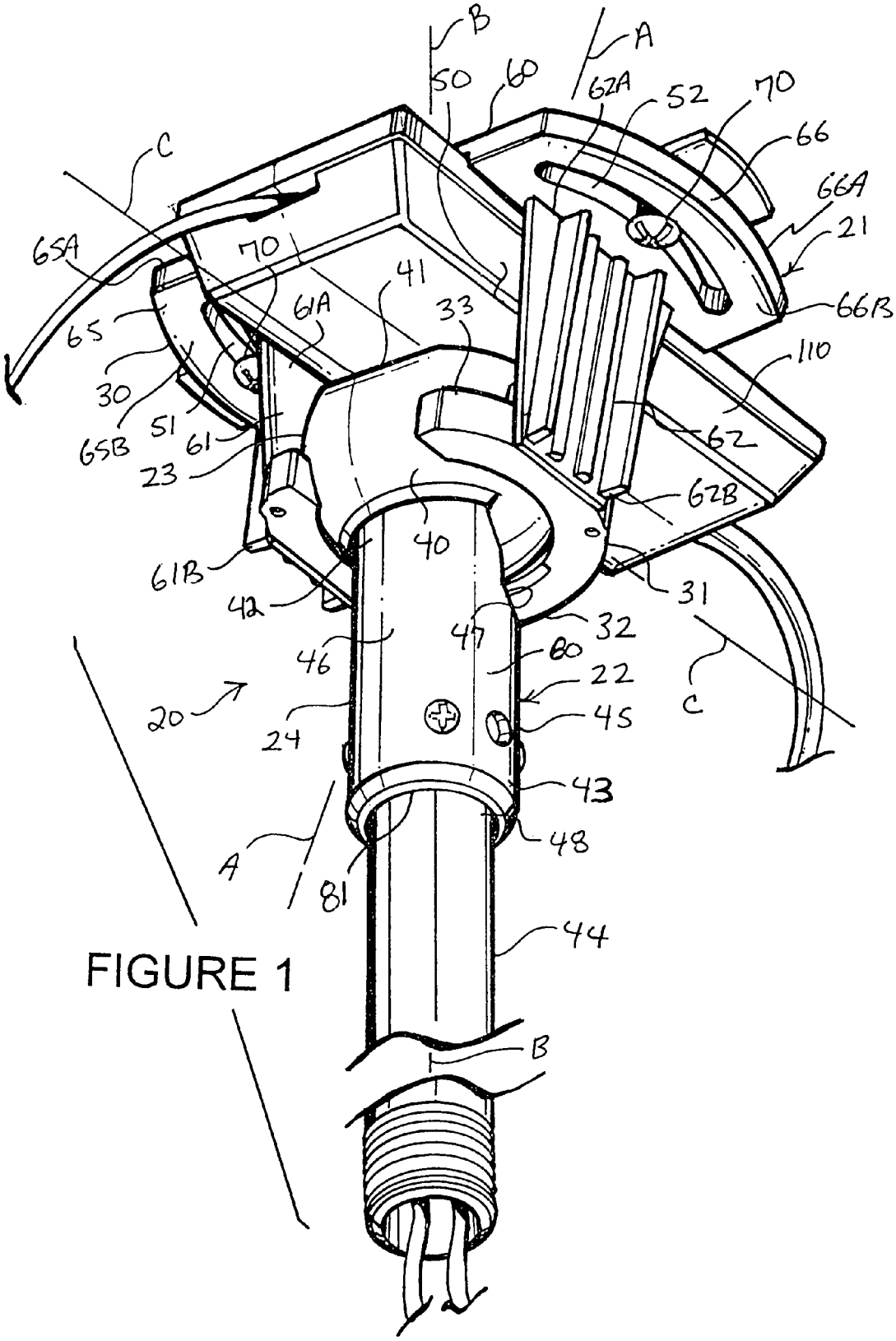
FIG. 1 is a perspective view of a hanger assembly including an adapter suspended from a hanger bracket, the adapter, the hanger bracket, and the combination of the adapter and the hanger bracket together forming the hanger assembly, each constructed and arranged in accordance with the principle of the invention, and there being an electrical device positioned in a gap between the adapter and the hanger bracket.

Turning now to the drawings, in which like reference characters indicate corresponding elements throughout the several views, attention is first directed to FIG. 1 in which is seen a ceiling fan hanger assembly, incorporating the teachings of the instant invention and generally designated by reference character 20. Hanger assembly is for depending a ceiling fan from an overhead surface, and, more particularly, from a sloped overhead surface, such as sloped ceilings and from load-bearing junction boxes mounted such that their mounting or attachment faces are disposed in a sloped orientation.

Figure 2:
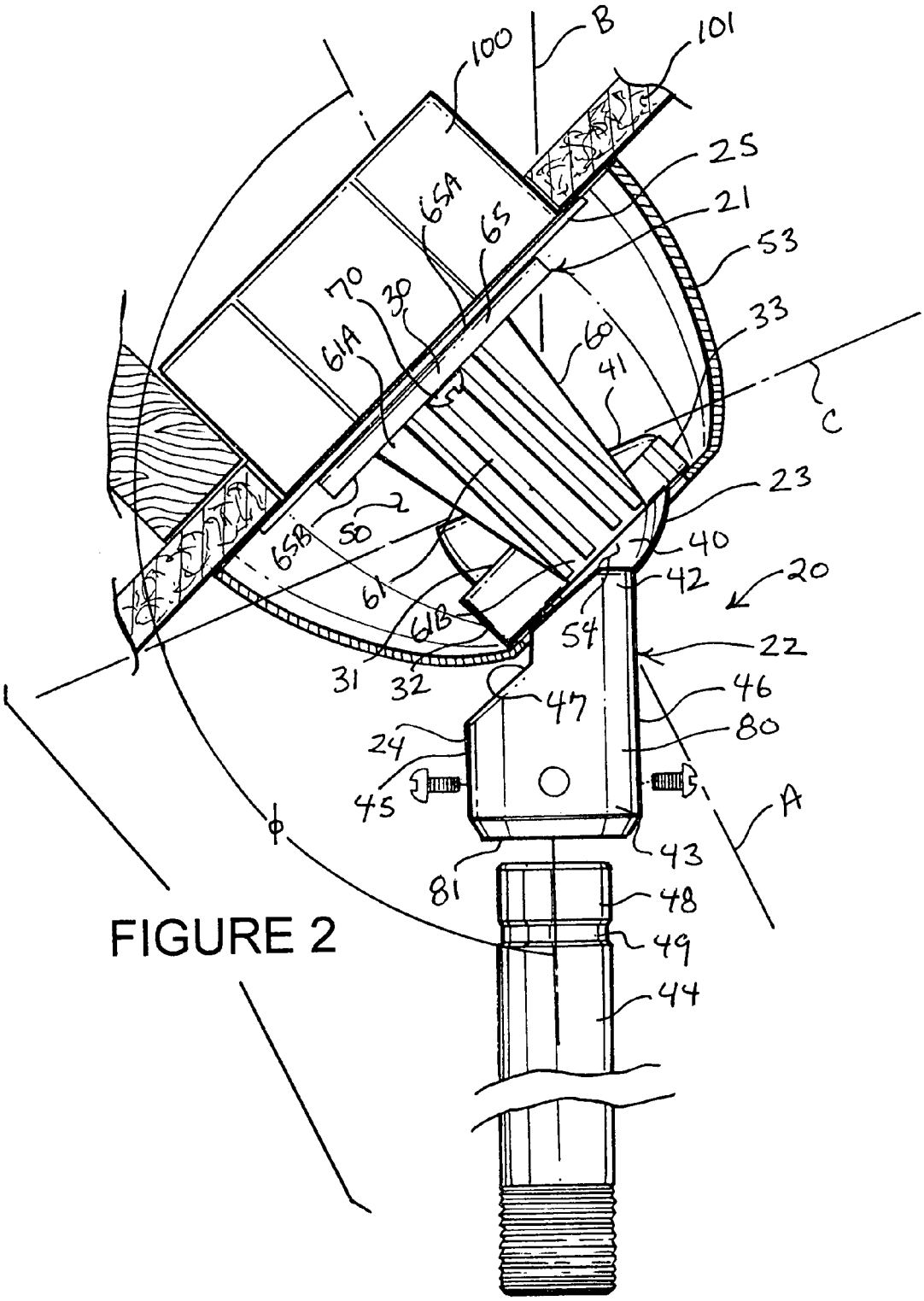
FIG. 2 is a side elevational view of the hanger assembly of FIG. 1 with the gap between the adapter and the hanger bracket shown as it would appear unoccupied.

Hanger assembly 20 includes a hanger bracket 21 and an adapter 22 formed with a head 23 and a down rod connector 24. Hanger bracket 20 includes an attachment end 30 and an opposing socket 31 having opposing front and rear ends 32 and 33. Attachment end 30 is adapted to be secured to a sloped attachment face 25 as shown in FIG. 2 disposing socket 31 in a sloped orientation that is substantially parallel relative to the slope of attachment face 25 with front end 32 of socket down-angled relative to rear end 33 of socket 31 as best seen in FIG. 2.

Head 23 has a lower face 40, which is rounded and matingly received or otherwise seated in socket 31, and an opposing upper face 41. An axis A perpendicular to upper face 41 extends through the geometric center of head 23.

Connector 24 is elongate and has an upper end 42 attached to head 23 and depends downwardly from lower face 40, and socket 31, to a lower end 43, which is adapted to be secured to a down rod 44. FIG. 1 shows down rod 44 secured to lower end 43 of connector 24, and FIG. 2 shows down rod 44 detached from lower end 43 of connector 24.

Connector 24 has a front face 45 facing front end 32 of socket 31, an opposing rear face 46 facing rear end 33 of socket 31, and an axis B extending longitudinally through the geometric center of connector 24 from its upper end 42 to its lower end 43. There is a salient angle $\phi$ shown in FIG. 2 of less than 180 degrees between axis A and axis B facing front end 32 of socket 31. A notch 47 is formed in front face 45 of connector 24 receiving therein front end 32 of socket 31, in accordance with the principle of the invention. Connector 24 can be of any specified length.

A receiving area or component-receiving space 50 is formed between upper face 41 of head 23 and attachment end 30 of hanger bracket 21. Attachment end 30 of hanger bracket 21 is formed with opposed, substantially coextensive inwardly-directed arcuate slots 51 and 52 (not shown in FIG. 2) each for accommodating a fastener for securing attachment end 30 to a sloped attachment face, such as attachment face 25 in FIG. 2, and for also permitting rotation or rotational adjustment of hanger bracket 31 relative to the sloped attachment face prior to tightening the fasteners securing attachment end 30 to the sloped attachment face. In FIG. 2, attachment face 25 forms part of a junction box. Front end 32 of socket 31 is closed, and rear end 33 of socket 31 is open. Head and connector 24 are preferably integrally formed, lower face 40 of head 23 is rounded, and upper face 41 of head 23 is substantially flat defining a plane C that is perpendicular relative to axis A and oblique relative to axis B.

In FIG. 2, a canopy 53 is shown in vertical cross section as it would appear mounted in place to attachment face 25 enclosing attachment face 25, engulfing hanger bracket 21, and substantially engulfing head 23. Canopy 53, generally in the shape of an inverted dome, includes a generally central opening 54 for receiving shaft down rod connector 24 therethrough. Attachment face 25 is disposed at an overhead location and forms part of load-bearing junction box 100 mounted to ceiling 101.

§B. The Hanger Bracket

Figure 13:
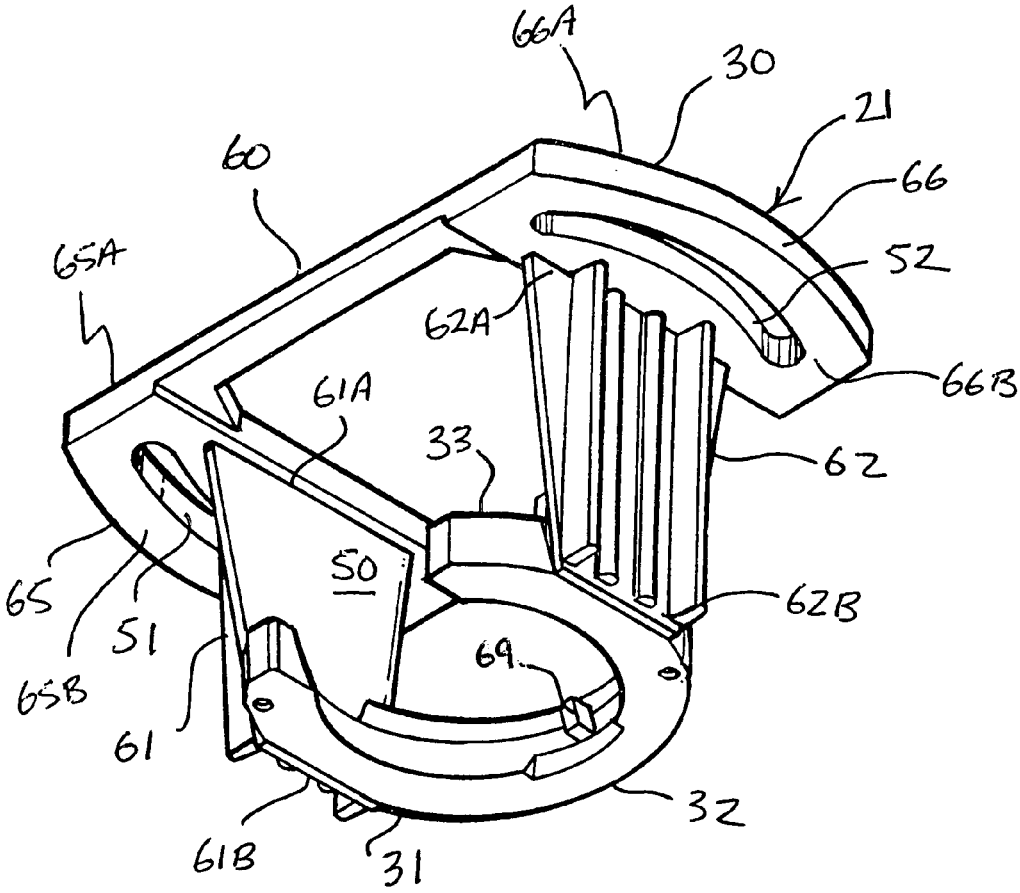
FIG. 13 is a bottom perspective view of the hanger bracket of FIG. 1.
Figure 17:
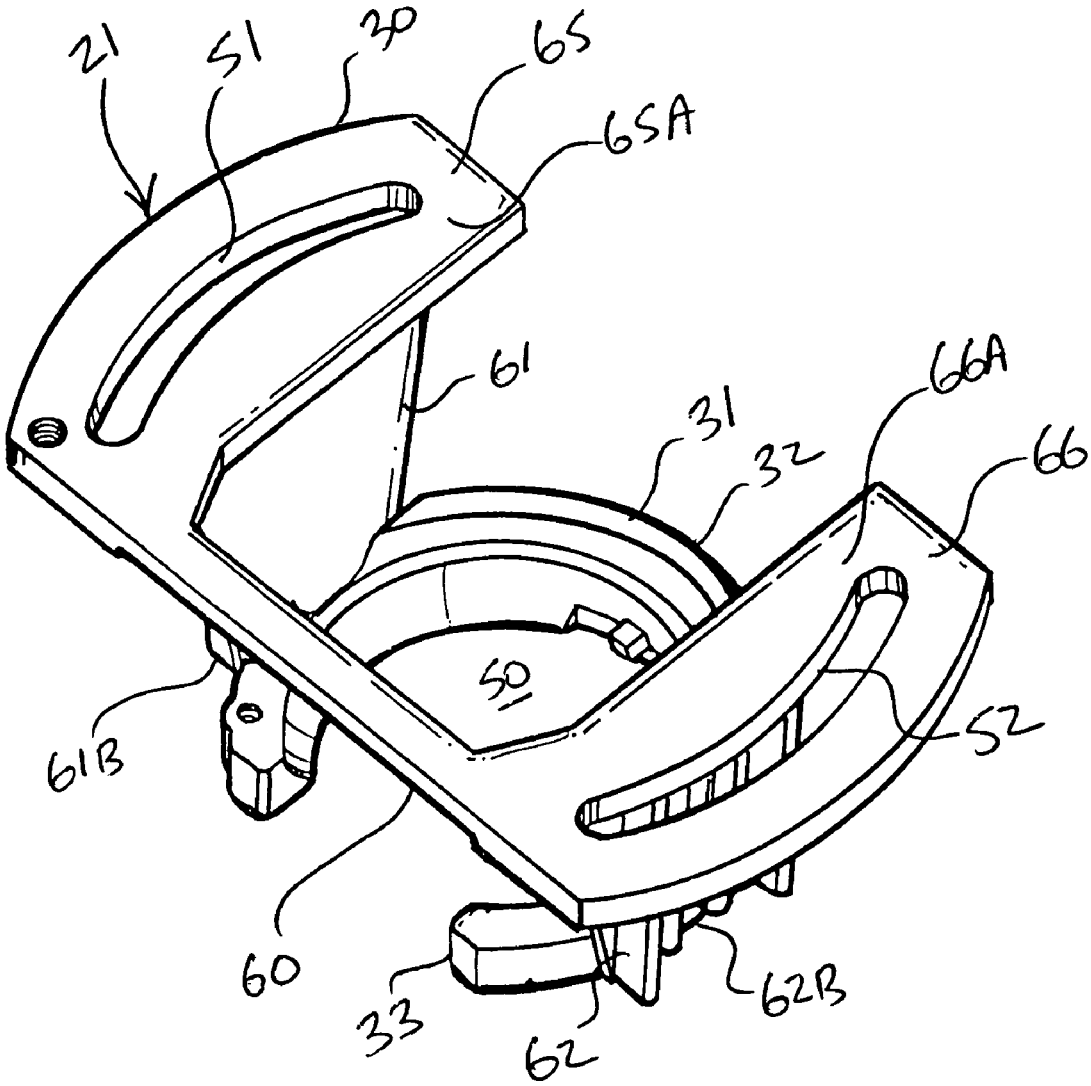
FIG. 17 is a top perspective view of the hanger bracket of FIG. 9.

Referring to FIG. 13, which is a bottom perspective view of hanger bracket 21 and also FIG. 17 which is a top perspective view of hanger bracket 21, hanger bracket 21 consists of a body 60 that is integrally formed of steel, aluminum, titanium or other strong, resilient material or combination of materials. Body 60 includes opposing, substantially parallel upstanding struts 61 and 62 having upper ends 61A and 62A, respectively, and opposing lower ends 61B and 62B, respectively.

Figure 16:
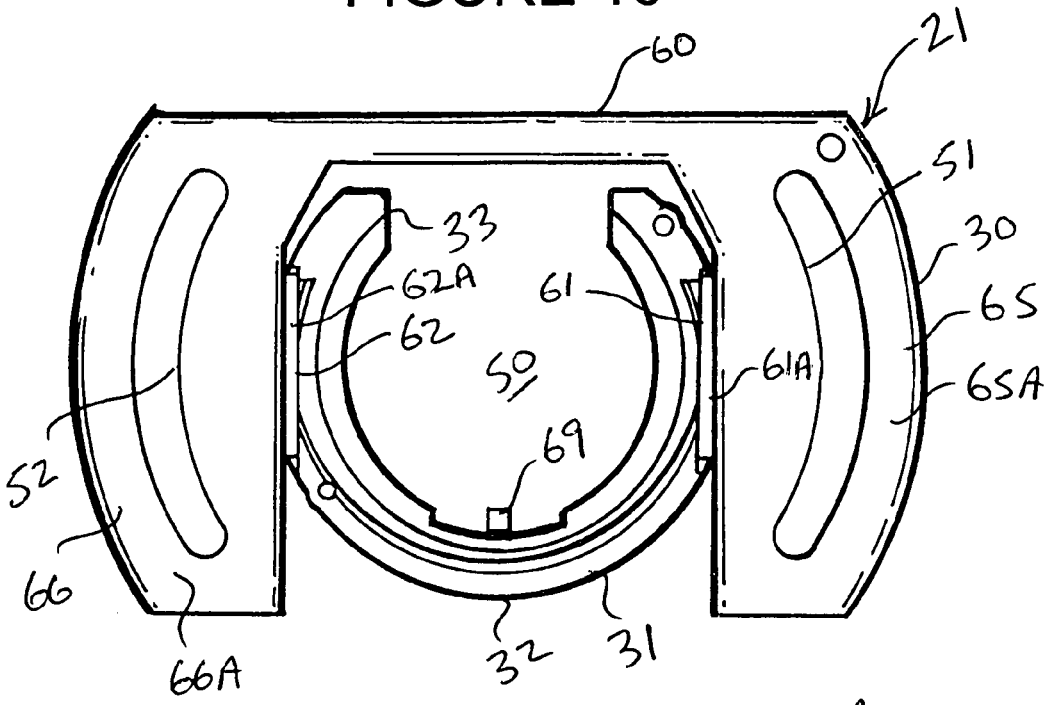
FIG. 16 is a top plan view of the hanger bracket of FIG. 9.

Tabs 65 and 66 are attached to upper ends 61A and 62A, respectively. Tab 65 has opposing upper and lower surfaces 65A and 65B, and is formed laterally outward of upper end 61A. Tab 66 has opposing upper and lower surfaces 66A and 66B, and is formed laterally outward of upper end 62A. Upper surfaces 65A and 66A are best seen in FIGS. 16 and 17. Slot 51 is formed in tab 65 and extends therethrough from upper surface 65A to lower surface 65B. Slot 52 is formed through tab 66 and extends therethrough from upper surface 66A to lower surface 66B. Referring also to FIGS. 11 and 16-18, slots 51 and 52 are diametrically opposed each being the mirror image of the other and each having an inwardly directed arcuate shape, in accordance with the principle of the invention.

Socket 31 is formed into hanger bracket 21 at a generally central location, and is positioned between, and attached to, lower ends 61B and 62B of struts 61 and 62. A key 69 projects radially inward from socket 31 at front end 32. Front end 32 is closed and rear end is open as shown. Space 50 is defined between struts 65 and 66, attachment end 30, and socket 31.

Figure 11:
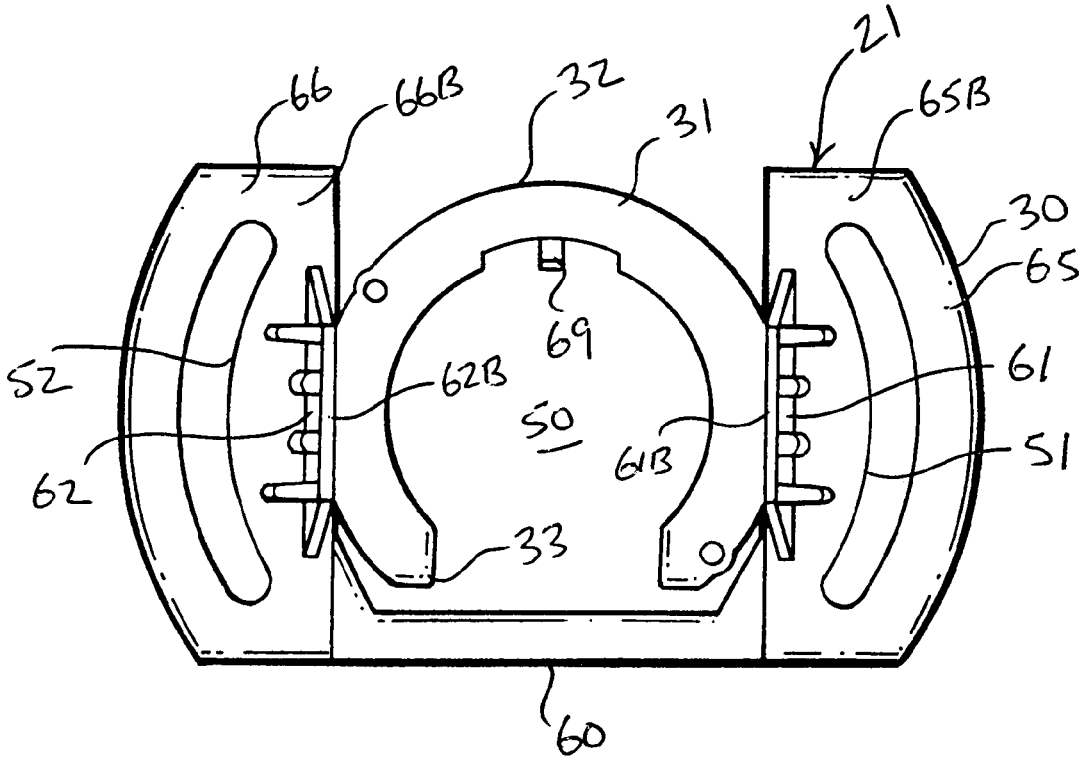
FIG. 11 is a bottom plan view of the hanger bracket of FIG. 1.
Figure 12:
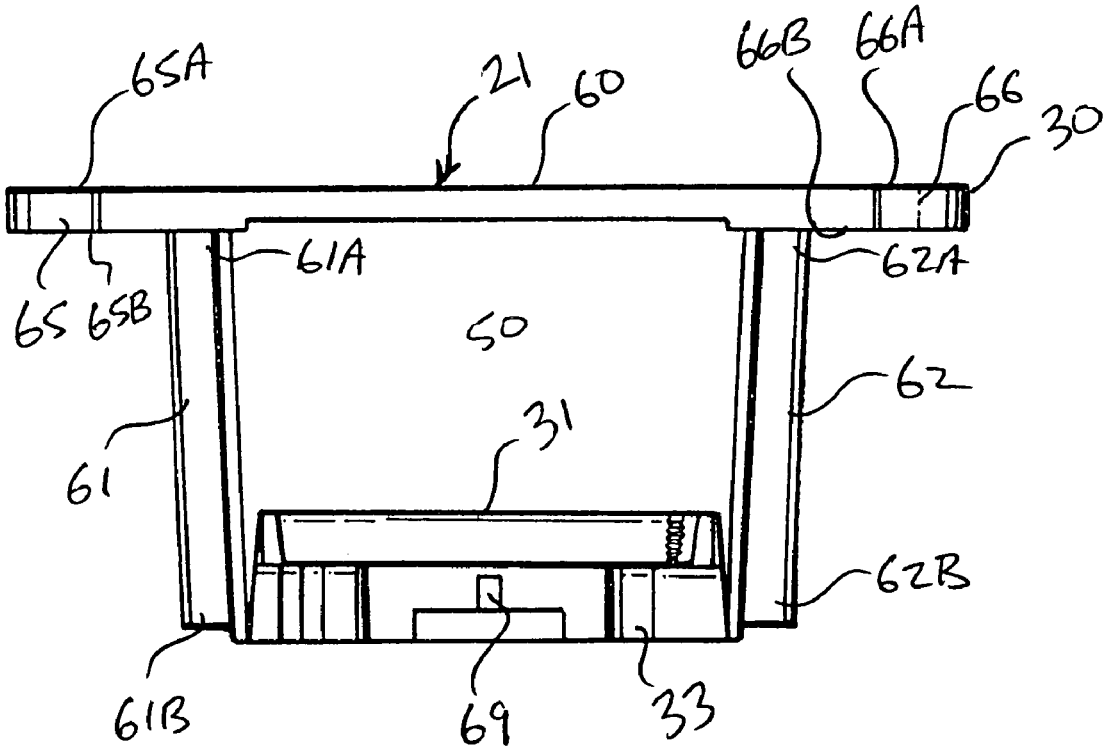
FIG. 12 is a rear elevational view of the hanger bracket of FIG. 1.
Figure 14:
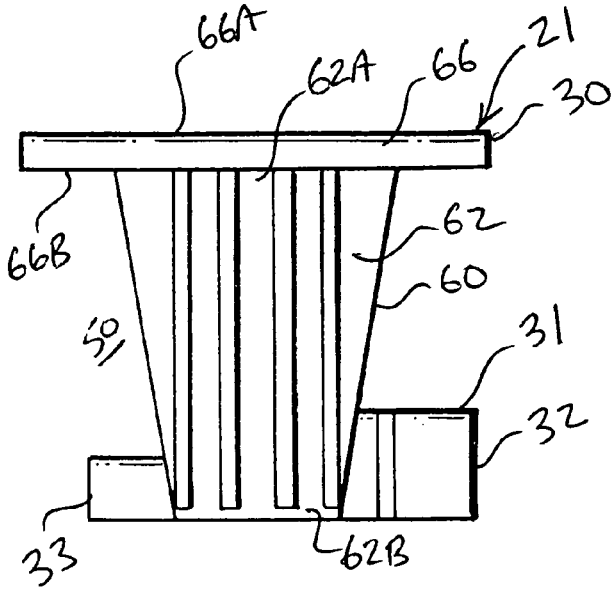
FIG. 14 is a left side elevational view of the hanger bracket of FIG. 1, the opposing right side elevational view being a mirror image thereof.
Figure 15:
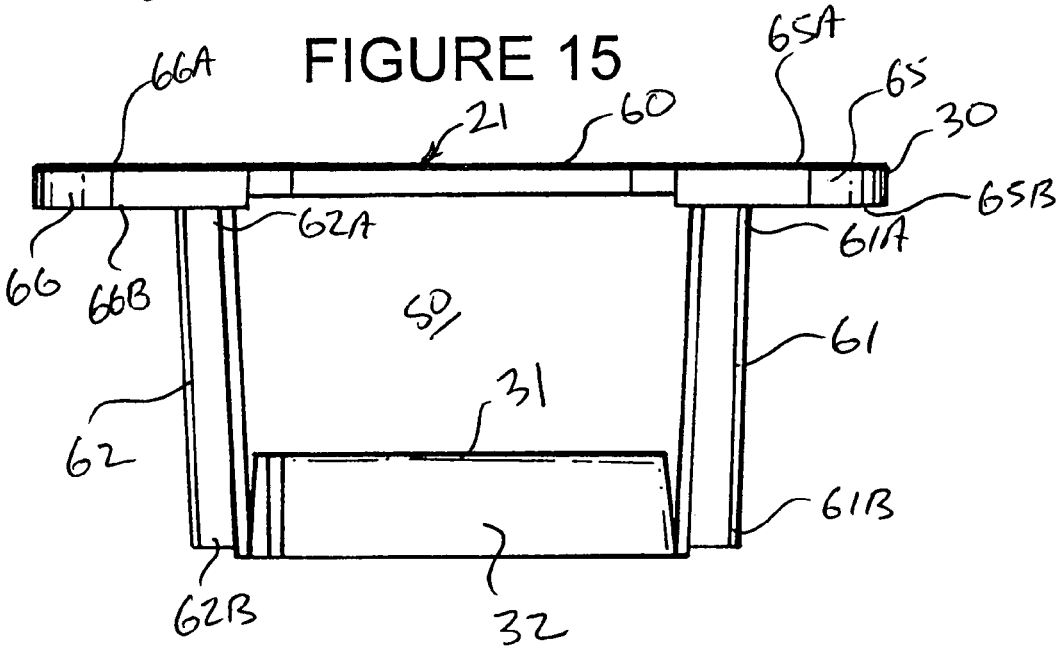
FIG. 15 is a front elevational view of the hanger bracket of FIG. 1.
Figure 18:
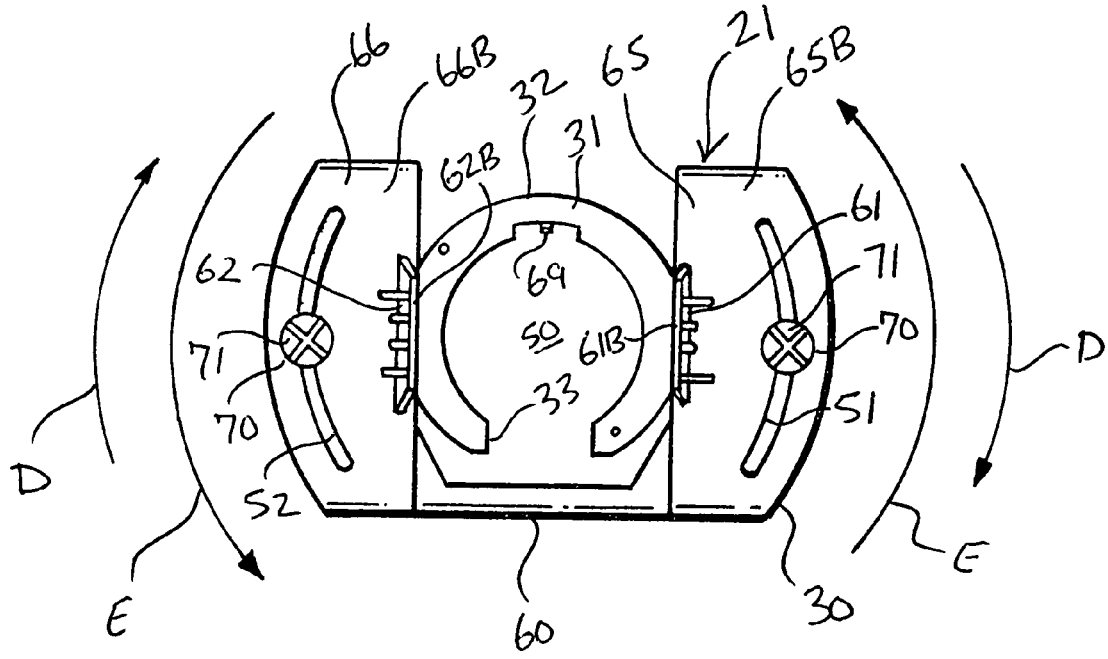
FIG. 18 is a bottom plan view of the hanger bracket of FIG. 1 showing attachment screws disposed in the opposed curved slots on either side thereof.

As a matter of disclosure, FIG. 11 is a bottom plan view of hanger bracket 21, FIG. 12 is a rear elevational view of hanger bracket 21 of FIG. 1, and FIG. 14 is a left side elevational view of hanger bracket 21, the opposing right side elevational view being a mirror image thereof. FIG. 15 is a front elevational view of hanger bracket 21, and FIG. 16 is a top plan view of hanger bracket 21. FIG. 18 is a bottom plan view of hanger bracket 21 showing attachment screws 70 disposed in slots 51 and 52. Screws 70 have heads 71 positioned against lower surfaces 65B and 66B of tabs 65 and 66.

§C. The Adapter

Referring to FIG. 4, which is a top perspective view of adapter 22, adapter 22 consists of a body 80 that is integrally formed of steel, aluminum, titanium or other strong, resilient material or combination of materials. Head 23 characterizes the upper end of body 80, and lower end 43 of down rod connector 24 characterizes the lower end of body 80. Lower surface 43 of head 23 is rounded, which allows head 23 to swivel in socket 31.

Lower end 43 of down rod connector 24 can be threaded, configured with one or more attachment pins, or otherwise configured for securement to a down rod to which a ceiling fan is to be attached. In the embodiment herein chosen as a matter of example, lower end 43 of down rod connector 24 is open and exemplary of a connector socket 81 into which the upper end of a down rod is received. Threaded openings through lower end 43 of down rod connector receive screws, which are tightened against the upper end of a down rod in connector socket 81 securing the down rod in place.

As a matter of example FIG. 2 shows upper end 48 of down rod 44 as it would appear detached from connector socket 81, and FIG. 1 shows upper end 48 of down rod 44 positioned in connector socket 81 and secured in place with screws through the threaded openings through lower end 43, and which are each seated into an annular groove 49 (FIG. 2) formed in upper end 44A of down rod 44.

FIGS. 3, 4, 5, and 10 show a bore 82 extending longitudinally through head 23 and down rod connector 24, which accommodate the electrical wires which extend from a junction box to the fan. Notch 47 formed in front face 45 of down rod connector 24 is clearly shown in FIGS. 4, 5, 6, and 8, and axes A and B, and also plane C of upper face 41, are illustrated for reference in FIGS. 4, 6, and 8.

As a matter of disclosure, FIG. 3 is a top plan view of adapter 22, FIG. 5 is a front elevational view of adapter 22, and FIG. 6 is a right side elevational view of adapter 22. Furthermore, FIG. 7 is a rear elevational view of adapter 22, FIG. 8 is a left side elevational view of adapter 22, FIG. 9 is a bottom perspective view of adapter 22, and FIG. 10 is a bottom plan view of adapter 22.

§D. Installation and Operation of the Hanger Assembly

Hanger assembly 20 is used to depend a ceiling fan from an overhead sloped attachment face. Upper faces 65A and 66A of attachment end 30 of hanger bracket 21 are presented up against the sloped attachment face, and upper end is secured in place with screws secured thereto from grooves 51 and 52. In FIG. 2, attachment end 30 is shown positioned up against sloped attachment face 25 forming part of junction box 100. In FIG. 2, junction box 100 is mounted to an overhead ceiling 101 in a conventional manner, in which the slop of ceiling 101 is, in this particular example, the same as the slope of attachment face 25.

FIG. 18 shows the disposition of screws 70 in slots 51 and 52 to be used for securing attachment end 30 of hanger bracket 21 to a sloped attachment face, such as attachment face 25 of junction box 100 shown in FIG. 2. Before tightening screws 70, arcuate slots 51 and 52 allow hanger bracket 21 to be rotated relative to screws 70 in a clockwise direction as indicated by the opposed arrowed lines D and in a counterclockwise direction as indicated by the opposed arrowed lines E. This allows hanger bracket 21 to be rotated for precisely positioning it so that in its sloped positioning the front end 32 of socket 31 is disposed downward and rear end 33 of socket 31 is disposed upward. After hanger bracket 21 is adjusted as needed, screws 70 are tightened securing attachment end 30 to the attachment face, such as attachment face 25 in FIG. 2 disposing socket 31 in a sloped orientation that is substantially parallel relative to the slope of attachment face 25 and also ceiling 101 with front end 32 of socket disposed down-angled relative to rear end 33 of socket 31.

At this point, adapter 22 is taken up, such as by hand, and fitted into socket 31. To position adapter 22 in socket 31, rear face 46 of adapter is directed toward the up-angled rear end 33 of socket while head 23 is positioned at space 50 just outboard or rearward of rear end 33. Adapter 22 is then moved forward passing upper end 42 of down rod connector 24 through rear end 33, which is open as previously explained allowing this to take place. Adapter 22 is moved forward until head 23 is positioned directly above socket 31. Adapter 22 is then lowered mating lower face 40 into socket 31. Key 69 is engaged within a keyway 102 (FIGS. 3, 4, 5, and 10) formed into the front of head 23. Down rod connector 24, having lower end 43, depends from lower face 40 through socket 31 and is available to be secured to a down rod to which ceiling fan is to be attached. Having completed the assembly and installation of hanger assembly 20, canopy 53 (FIG. 2) may then positioned in place in juxtaposition to ceiling 101 engulfing hanger bracket 21 and then secured with screws to junction box 100.

Because socket 31 is sloped with front end 32 thereof being down-angled relative to rear end 33, when left to hang therefrom axis A of down rod connector 24 is vertical and notch 47 receives therein front end 32 of socket 31 as shown in FIGS. 1 and 2. Accordingly, notch 47 accommodates forward end 32 of socket 31, which allows socket 31 to be angularly disposed relative to the vertical orientation of down rod connector 24 depending therefrom. The provision of notch 47 receiving front end 32 of socket 31 eliminates undesirable physical interaction between down rod connector 24 and front end 32 of socket 31 that would otherwise inhibit down rod connector 24 from depending vertically and freely from sloped socket 31, in accordance with the principle of the invention.

Referring to FIG. 2 showing adapter 22 suspended from socket 31, plane C of upper face 41 is not horizontal, but rather is angled upwardly toward attachment face 25, attachment end 30, and ceiling 101. This is particularly due to the angular disposition of head 23 relative to down rod connector 24 as defined by axis A and axis B, respectively. In hanger bracket 21 mounted to a sloped attachment face with socket 31 thereof disposed in a sloped orientation as herein described, the described upturned, angular disposition of upper face 41 toward attachment end 30 of hanger bracket 21 reduces the encroachment of head 23 into space 50 increasing its available size allowing it to accept an electrical component, in accordance with the principle of the invention, such as electrical component 110 in FIG. 1. Electrical component 110 is a remote control sensor for controlling the operation of a ceiling fan in response to the controlled operation of a remote control device or console. If desired, electrical component 110 may be a hard-wired controller for controlling the operation of a ceiling fan in response to the controlled operation of a control device or console.

§E. Conclusion

Those having regard for the art will readily appreciate that an exemplary hanger assembly is disclosed, which is particularly adapted and arranged to depend a ceiling fan from a sloped attachment face. Hanger assembly 20 is low in cost, which is due, at least in part, to the preferred integral formation of hanger bracket 21 and also adapter 22. Hanger assembly 20 is simple in structure, easy to produce, easy to install, and reliable. Although adapter 22 is discussed in conjunction with hanger bracket 21, adapter 22 may be similarly used with conventional hanger brackets and also conventional canopies requiring no specialized hanger bracket or canopy for it to be used according to the principle of the invention.

Head 23 and down rod connector 24 may be constructed as desired for providing a specific degree of salient angle $\phi$ between axis A of head and axis B of down rod connector 24. The degree of salient angle $\phi$ will depend on the slope of the attachment face to which hanger bracket 21 is to be attached and, moreover, the slope of socket 31 after hanger bracket 21 is installed. Clearly, the steeper the slope of socket 31 the smaller salient angle $\phi$ between axis A and axis B must be. So, a determination may be made of the slope of the socket 31 after it is mounted in place, after which an adapter may be provided in accordance with the principle of the invention having a salient angle $\phi$ between axis A of head 23 and axis B of down rod connector 24 so that the resulting hanger assembly consisting of the provided adapter suspended from the hanger bracket will have the same structure and configuration of hanger assembly 20 herein described and, moreover, the same resulting function.

The present invention is described above with reference to a preferred embodiment. However, those skilled in the art will recognize that changes and modifications may be made in the described embodiment without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A hanger assembly for depending a ceiling fan from an overhead sloped attachment face, comprising:

a hanger bracket including an attachment end and an opposing socket having opposing front and rear ends, the attachment end adapted to be secured to the sloped attachment face disposing the socket in a sloped orientation substantially parallel relative to the sloped attachment face with the front end thereof being down-angled relative to the rear end thereof;

an adapter formed with a head and a down rod connector;

the head having a lower face seated in the socket and an opposing upper face, and a first axis perpendicular to the upper face;

the upper face of the head is substantially flat defining a plane that is perpendicular relative to the first axis;

a component-receiving space formed between the upper face of the head and the attachment end of the hanger bracket;

the down rod connector having an upper end attached to the head and depending downwardly from the lower face thereof to a lower end adapted to be secured to a down rod, a front face facing the front end of the socket, an opposing rear face facing the rear end of the socket, and a second axis extending parallel with respect to the down rod connector from the upper end to the lower end; and the second axis parallel with respect to the down rod connector and divergent relative to the first axis to form a salient angle of less than 180 degrees between the first axis and the second axis facing the front end of the socket reducing encroachment of the head into the component-receiving space formed between the upper face of the head and the attachment end of the hanger bracket; and a notch formed in the front face of the down rod connector to receive the front end of the socket.

2. The hanger assembly according to claim 1, wherein the attachment end of the hanger bracket is formed with opposed, substantially coextensive inwardly-directed arcuate slots each for accommodating a fastener for securing the attachment end to the sloped attachment face.

3. The hanger assembly according to claim 1, wherein the front end of the socket is closed.

4. The hanger assembly according to claim 1, wherein the rear end of the socket is open.

5. The hanger assembly according to claim 1, wherein the head and the down rod connector are integrally formed.

6. The hanger assembly according to claim 1, wherein the lower face of the head is rounded.

7. A hanger assembly for a ceiling fan, comprising:

a junction box, mounted at an overhead location and having a sloped attachment face;

a hanger bracket including an attachment end affixed to the sloped attachment face and an opposing socket spaced from and substantially parallel to the sloped attachment face of the junction box and having opposing front and rear ends, the front end down-angled relative to the rear end;

an adapter formed with a head and a down rod connector;

the head having a lower face seated in the socket and an opposing upper face, and a first axis perpendicular to the upper face;

the upper face of the head is substantially flat defining a plane that is perpendicular relative to the first axis;

a component-receiving space formed between the upper face of the head and the attachment end of the hanger bracket;

the down rod connector having an upper end attached to the head and depending downwardly from the lower face thereof to a lower end adapted to be secured to a down rod, a front face facing the front end of the socket, an opposing rear face facing the rear end of the socket, and a second axis extending parallel with respect to the down rod connector from the upper end to the lower end; and the second axis parallel with respect to the down rod connector and divergent relative to the first axis to form a salient angle of less than 180 degrees between the first axis and the second axis facing the front end of the socket reducing encroachment of the head into the component-receiving space formed between the upper face of the head and the attachment end of the hanger bracket; and a notch formed in the front face of the down rod connector to receive the front end of the socket.

8. The hanger assembly according to claim 7, wherein the attachment end of the hanger bracket is formed with opposed, substantially coextensive inwardly-directed arcuate slots each accommodating therethrough a fastener securing the attachment end to the attachment face of the junction box.

9. The hanger assembly according to claim 7, wherein the front end of the socket is closed.

10. The hanger assembly according to claim 7, wherein the rear end of the socket is open.

11. The hanger assembly according to claim 7, wherein the head and the down rod connector are integrally formed.

12. The hanger assembly according to claim 7, wherein the lower face of the head is rounded.

13. In a sloped attachment face disposed at an elevated location, and a hanger bracket including an attachment end affixed to the sloped attachment face and an opposing socket spaced from and substantially parallel to the sloped attachment face and having opposing front and rear ends, the front end down-angled relative to the rear end, improvements therein comprising:

an adapter formed with a head and a down rod connector;

the head having a lower face seated in the socket and an opposing upper face, and a first axis perpendicular to the upper face;

the upper face of the head is substantially flat defining a plane that is perpendicular relative to the first axis;

a component-receiving space formed between the upper face of the head and the attachment end of the hanger bracket;

the down rod connector having an upper end attached to the head and depending downwardly from the lower face thereof to a lower end adapted to be secured to a down rod, a front face facing the front end of the socket, an opposing rear face facing the rear end of the socket, and a second axis extending parallel with respect to the down rod connector from the upper end to the lower end; and the second axis parallel with respect to the down rod connector and divergent relative to the first axis to form a salient angle of less than 180 degrees between the first axis and the second axis facing the front end of the socket reducing encroachment of the head into the component-receiving space formed between the upper face of the head and the attachment end of the hanger bracket; and a notch formed in the front face of the down rod connector to receive the front end of the socket.

14. The improvements according to claim 13, wherein the head and the down rod connector are integrally formed.

15. The improvements according to claim 13, wherein the lower face of the head is rounded.

* * * * *